United States Patent [19]

Watanabe et al.

[11] 4,323,833

[45] Apr. 6, 1982

[54] SEWING MACHINE DRIVE MOTOR CONTROL SYSTEM

[75] Inventors: Kazuo Watanabe, Hachioji; Hachiro Makabe, Fussa; Akira Orii, Sagamihara; Michio Hisatake, Hino; Kazuji Yamamoto, Koganei, all of Japan

[73] Assignee: Janome Sewing Machine Co., Ltd., Tokyo, Japan

[21] Appl. No.: 28,185

[22] Filed: Apr. 9, 1979

[30] Foreign Application Priority Data

| | | | |
|---|---|---|---|
| Apr. 12, 1978 | [JP] | Japan | 53/42178 |
| Apr. 20, 1978 | [JP] | Japan | 53/45905 |
| May 18, 1978 | [JP] | Japan | 53/59428 |

[51] Int. Cl.[3] ..... H02P 5/16

[52] U.S. Cl. ..... 318/376; 318/269; 318/345 G

[58] Field of Search ..... 318/345 G, 345 C, 375, 318/379, 380, 381, 467, 269; 307/252 UA; 112/275

[56] References Cited

U.S. PATENT DOCUMENTS

| | | | |
|---|---|---|---|
| 3,188,547 | 6/1965 | Zelina | 318/380 |
| 3,189,811 | 6/1965 | King | 318/380 |
| 3,325,714 | 6/1967 | Torii | 318/269 |
| 3,544,873 | 12/1970 | Gunsser et al. | 318/376 |
| 3,705,990 | 12/1972 | Pileckis | 307/252 UA |
| 3,753,059 | 8/1973 | Berman | 318/369 |
| 3,812,409 | 5/1974 | Dinger | 318/310 |
| 3,848,169 | 11/1974 | Asano et al. | 318/381 |
| 4,013,933 | 3/1977 | Dohi et al. | 318/467 |

*Primary Examiner*—David Smith, Jr.
*Attorney, Agent, or Firm*—Michael J. Striker

[57] ABSTRACT

A braking and speed-control circuit is disclosed which prevents excessive current from being dissipated in a DC series motor. The circuit includes two free-wheeling diodes, a forward-biased diode, and a thyristor. The forward-biased diode is placed between the field coil and the armature winding of the motor. One free-wheeling diode is placed across the entire motor circuit, including the forward-biased diode. The other free-wheeling diode is placed across the forward-biased diode and the field coil. The thyristor can short across the forward-biased diode and the armature winding.

6 Claims, 16 Drawing Figures

FIG. 5-A
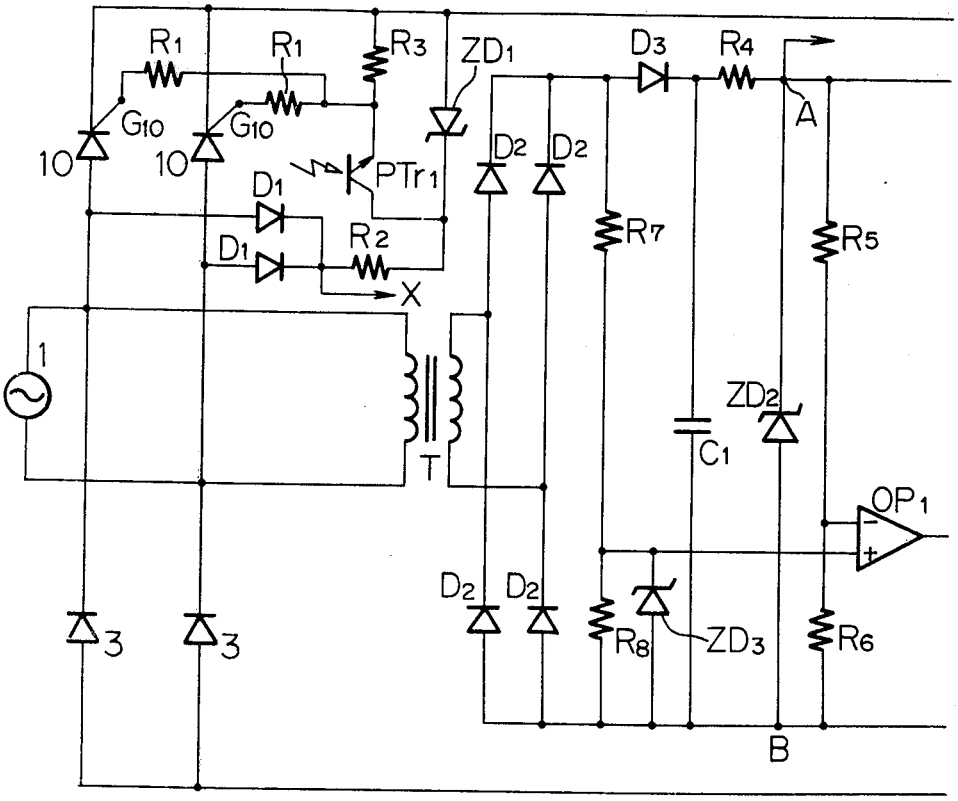
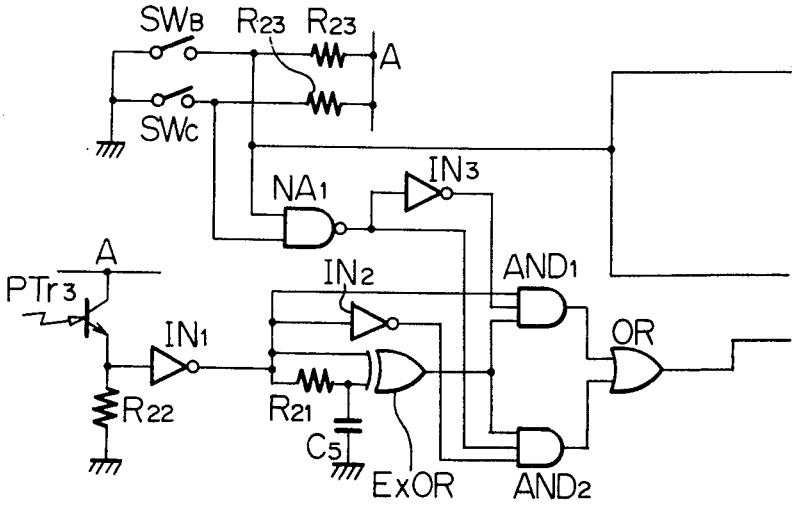

FIG_5-B
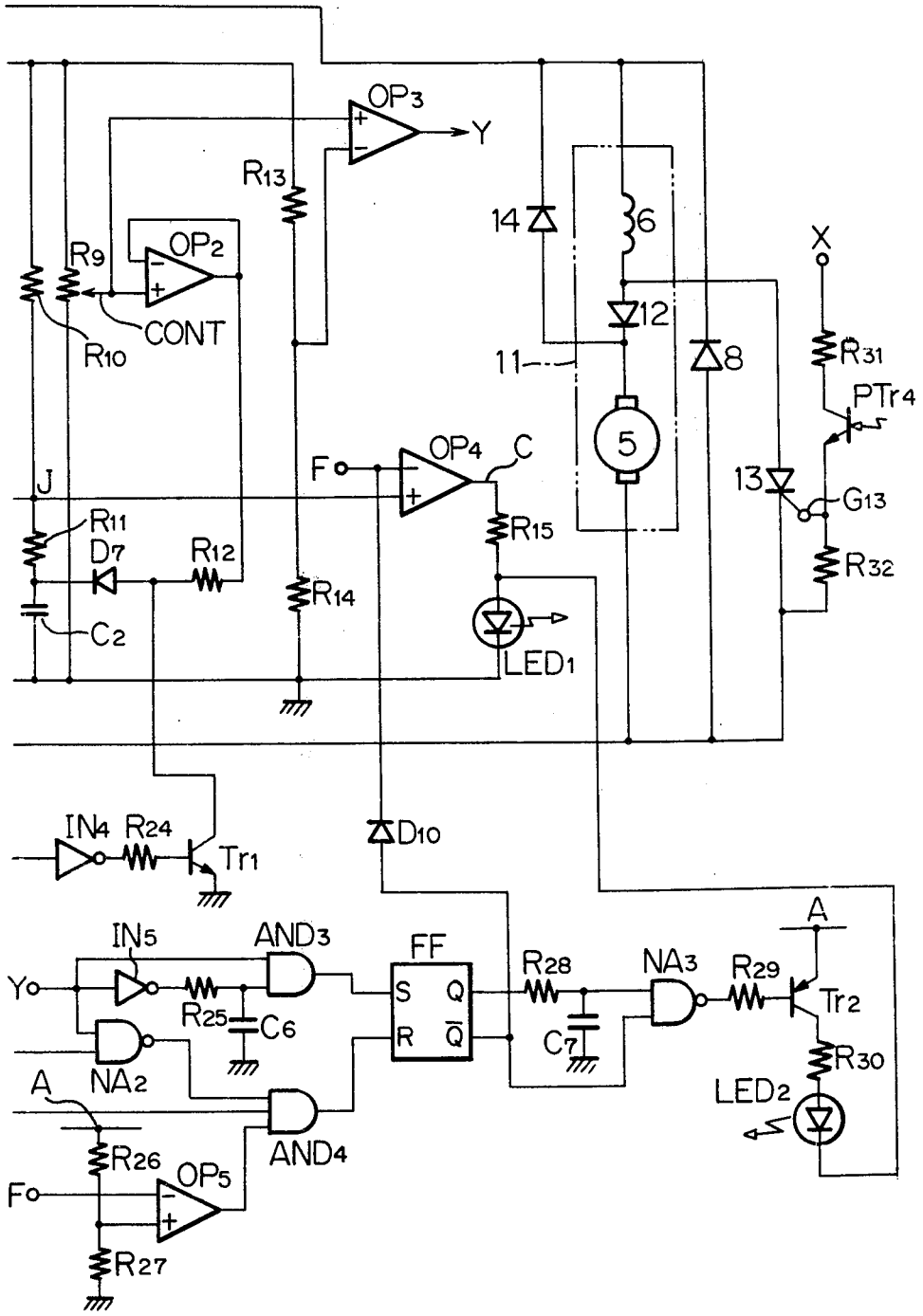

SEWING MACHINE DRIVE MOTOR CONTROL SYSTEM

BACKGROUND OF THE INVENTION

The invention relates to a control for a drive motor in a sewing machine. More particularly, this invention relates to a control system which will regulate motor speed in a stable fashion as such speed is increased and decreased and which will also stop the motor.

A prior art system of this kind is shown in FIG. 1, in which together with thyristors 2, diodes 3, form a full-wave rectifying bridge which supplies a DC motor. Thyristors 2 are phase-controlled by a gate control device (not shown) connected to their gates $G_2$, and the motor 4 is thus speed-controlled by the phase-controlled voltages applied to gates $G_2$, and numerals 7 and 8 are free wheel diodes. A braking thyristor 9 is connected in parallel with the armature 5, and after receiving a control signal (not shown) at its gate $G_9$, short-circuits an armature 5 during motor braking, so as to consume the motor's rotational energy by dissapating it in the armature's own resistance. FIG. 2 shows the operating relations of the circuit elements during the drive and braking periods of the motor. In FIG. 2 line $G_2$ designates a presence or non-presence of a gate signal of motor control thyristors 2, and during the period $t_1$ to $t_2$ indicates a phase-control voltage applied to thyristors 2. Line $G_9$ shows a gate signal applied to braking thyristor 9, and the period between $t_2$ and $t_4$ shows a period of time in which the thyristor 9 is conductive (as shown by the level of line 9) to brake motor 4. Line N shows the speed of the motor 4, which during the period between $t_1$ and $t_2$ is driven at a speed determined by the gate signal $G_2$. When thyristor 9 is conductive at the point $t_2$ for braking the motor, field coil 6 is energized via short-circuited thyristor 9, since the thyristor 2 has been fired. Armature 5, therefore, generates reverse EMF from time $t_2$ and the armature 5 carries current via thyristor 9. The rotational energy of the armature and the elements connected thereto is then consumed by the internal resistance of armature 5 and motor 4 is rapidly stopped. In FIG. 2, motor speed N is reduced at time $t_2$, following the solid curved line. But, depending upon AC power source phase, speed, and motor load at time $t_2$, the required stopping time for the motor can vary as is shown by dotted lines a and b. Therefore, in order to exactly stop the motor in a predetermined period, gate signals $G_2$ and $G_9$ are prolonged respectively, to times $t_3$ and $t_4$. Accordingly, the field coil 6 is unnecessarily heated by a comparatively large electric current until time $t_3$—i.e. even after the motor stops. The prolongation of gate signal $G_9$ serves the purpose of preventing the motor from rerotating. Such rerotation otherwise take place because cutoff of thyristor 2 is unstably dependent upon the phase of the AC power source at time $t_3$, and may lag about a half cycle behind time $t_3$, causing field coil 6 to be energized after cutoff of thyristor 9. This is the reason why such a timing control is necessary. However, such a timing control may cause erroneous operations of the circuit elements.

The present invention has been provided to eliminate such defects and disadvantages of the prior art.

SUMMARY OF THE INVENTION

It is a basic object of the invention to compensate for variations of the motor load and the power source over the whole speed range of the motor to thereby provide special stabilization.

It is another object of the invention to avoid supplying electric current to the motor while simultaneously generating electricity therein, to thereby stop the motor quickly and accurately.

Many other features and advantages of the invention will be apparent from the following description of its actual embodiments.

BRIEF DESCRIPTION OF THE DRAWINGS

FIGS. 5A and 5B represent circuit showing an actual embodiment of the invention, including the circuit of FIG. 3;

DETAILED DESCRIPTION OF THE PREFERRED EMBODIMENTS

Figure 3:
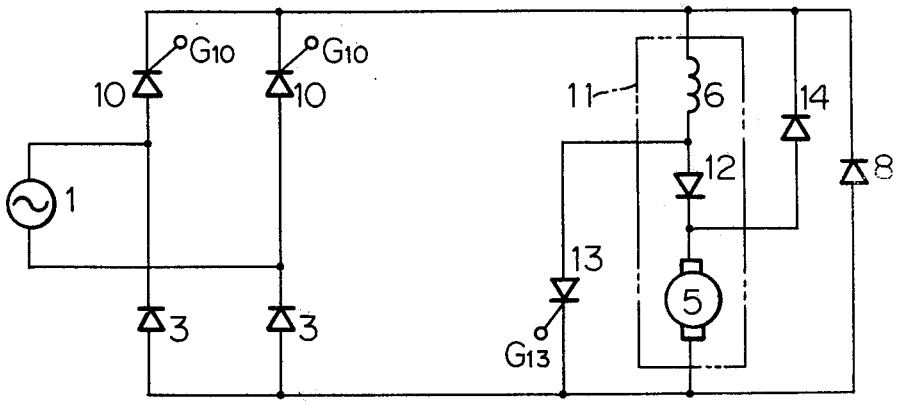
FIG. 3 is a schematic diagram of the basic parts of invention.

In FIG. 3, thyristors 10 and diodes 3 constitute a full wave bridge rectifier. $G_{10}$ designates gate terminals of thyristors 10, to which gates a motor control signal can be applied. Reference numeral 11 indicates a DC motor having an armature 5 to which a field coil 6 is connected via diode 12 which conducts current in the same direction do thyristors 10. Braking thyristor 13 conducts current in the same direction as do thyristors 10 and is connected in parallel with a series network of armature 5 and diode 12. $G_{13}$ designates a gate terminal of thyristor 13. A second braking diode 14 conducts in an opposite direction to thyristors 10 and is connected in parallel with a series network of field coil 6 and diode 12 to serve as a freewheel diode for field coil 6.

Figure 1:
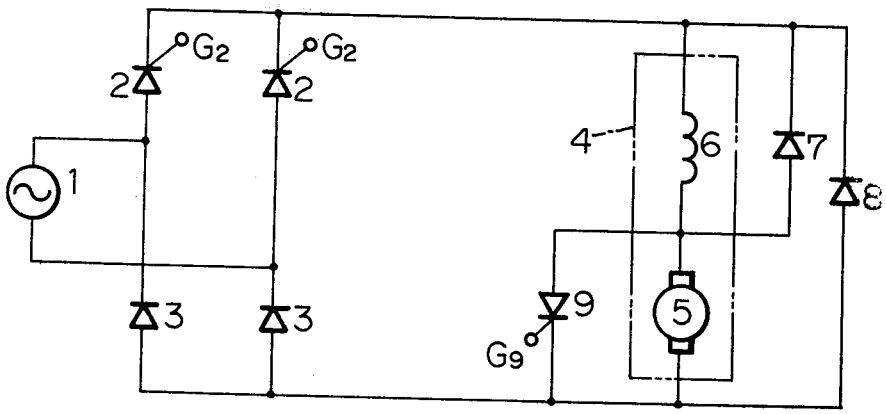
FIG. 1 PRIOR ART
FIG. 1 is a prior-art control circuit.
Figure 2:
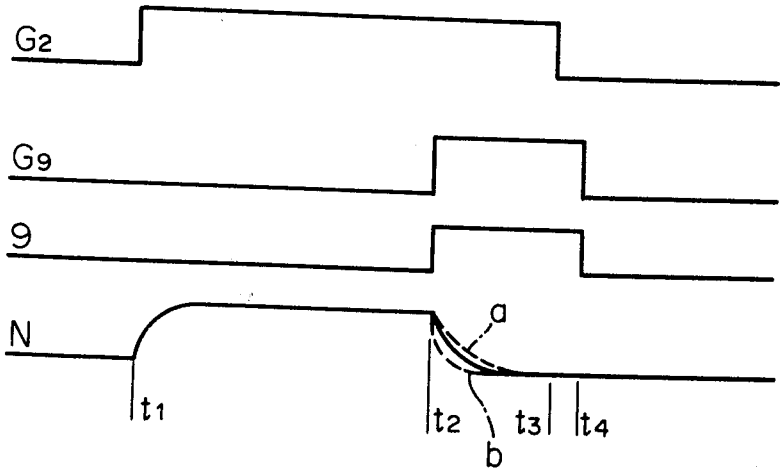
FIG. 2 PRIOR ART
FIG. 2 are graphs associated with FIG. 1.
Figure 4:
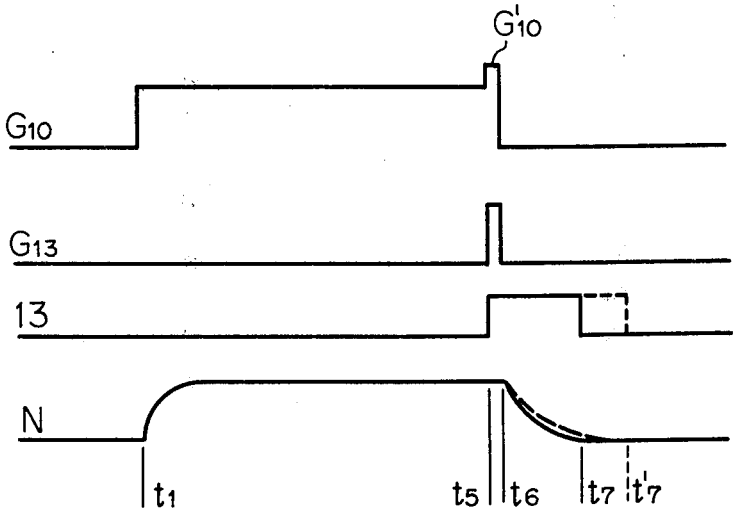
FIG. 4 are graphs associated with FIG. 3.

FIG. 4 differs FIG. 2 in that braking thyristor 13 receives a gate pulse $G_{13}$ at time $t_5$ having a width which is considerably narrower than the braking period. Just after thyristor 13 is fired the motor is braked and thyristor 13 cuts off when motor speed N is reduced to zero at time $t_7$. However, depending upon loading conditions of motor 11, the conductive period of the thyristor 13 is extended (as shown by the dotted line) until the speed N of motor 11 ceases at time $t'_7$. This will be explained with reference to FIG. 3. While thyristors 10 are ignited by gate signal $G_{10}$ and motor 11 is rotated, braking signal $G_{13}$ and maximum signal $G'_{10}$ are delivered to braking thyristor 13 and thyristors 10 at time $t_5$, for braking motor 11. In FIG. 4, signal $G'_{10}$ is shown at a level higher than signal $G_{10}$ for the sake of convenience to show that thyristors 10 are fired for the maximum ignition angle. Such an ignition angle temporarily increases current flowing through field coil 6 to make the motor brake more effective. Braking signal $G_{13}$ also fires thyristor 13 for a maximum ignition angle for the same purpose. Field coil 6 is thus strongly energized by the maximum ignition of thyristors 10 and 13, and, on the other hand, armature 5 is not supplied with current because it is short-circuited by thyristor 13. When each of the ignition signals disappears at time $t_6$, thyristor 10 is cut off at a zero crossover point of AC power source 1. Meanwhile, thyristor 13 continues to discharge the electromagnetic energy stored in field coil 6 and simultaneously consumes current generated in armature 5, via a short circuit path through diode 14 across field coil 6, just after cutoff of thyristors 10. Thus, rotating energy of motor 11 is consumed by resistance of armature 5 and field coil 6, and the motor 11 is dynamically braked and is rapidly stopped. Thyristor 13 does not receive a braking signal $G_{13}$ during the braking period, but the current generated during motor rotation holds the thyristor conductive until it disappears. A diode 12 passes this current through field coil 6, and prevents this current from passing through only thyristor 13 and thus directly short-circuited.

Figure 6:
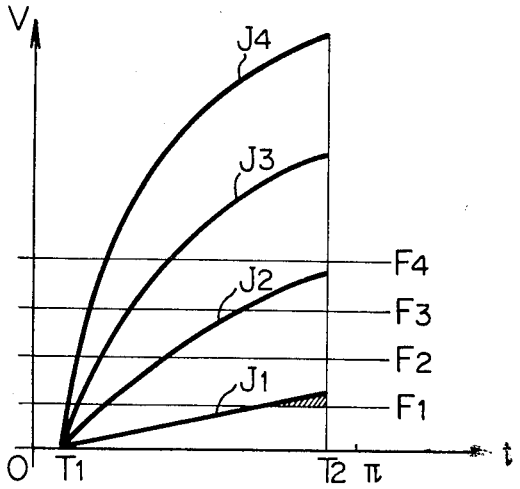
FIG. 6 are graphs associated with FIGS. 5A and 5B.

FIGS. 5A and 5B show an embodiment of a control circuit embodying the gate circuits which were omitted in FIG. 3. Motor 11 is used for driving a sewing machine having a speed control and a brake. Thyristors 10 are fired by a phototransistor $PTr_1$ receiving light from light-emitting diode $LED_1$, which is driven by an output of operational amplifier $OP_4$, further described below. In this control circuit, $R_1$, $R_2$ and $R_3$ are resistors. $D_1$ is a diode. $ZD_1$ is a Zener diode for compensating voltage variations of power source 1. T is a stepdown transformer. Diodes $D_2$ constitute a full wave rectifier. $D_3$ is a diode. $C_1$ is a voltage smoothing capacitor. $R_4$ is a resistor. $ZD_2$ is a Zener diode compensating for voltage variations of the power source 1 to provide a constant voltage between connections A and B. $OP_1$ is an operational amplifier having an inverting input receiving a constant voltage divided by resistors $R_5$ and $R_6$ between connections A and B, and having a non-inverting input receiving a full wave rectified voltage from diodes $D_2$, after division by resistors $R_7$ and $R_8$. The value of resistor 8 is set much larger than those of resistors $R_5$, $R_6$, and $R_7$ which are of like value. Values of resistors $R_5$–$R_8$ are so set that the power source period $0$–$\pi$ may be bigger than the (+) and (−) sides of operational amplifier $OP_1$. $ZD_3$ is a Zener diode for protecting operational amplifier $OP_1$. $OP_2$ is an operational amplifier having a non-inverting input receiving a divided voltage between the connections A and B from a potentiometer $R_9$ adjusted by a machine control (not shown). Potentiometer $R_9$ has a wiper CONT usually returned to its lowest end. As the wiper is moved up, the rotation speed of the motor is increased, and the motor is stopped when the contact is moved all the way down. The output side operational amplifier $OP_1$ is connected to connection A via resistor $R_{10}$, and is connected to connection B via a small resistor $R_{11}$ and a capacitor $C_2$. The output of operational amplifier $OP_2$ is connected to its inverting and is also connected to a point between the resistor $R_{11}$ and the capacitor $C_2$, via resistor $R_{12}$ and diode $D_7$. These operational amplifiers $OP_1$ and $OP_2$ and capacitor $C_2$ operate signals $J_1$–$J_4$ (shown in FIG. 6) at the output of operational amplifier $OP_1$. FIG. 6 indicates the speed of motor 11 in dependence upon position of the wiper CONT. The output of operational amplifier $OP_1$ is connected to the non-inverting input of operational amplifier $OP_4$. As is shown in FIG. 6, operational amplifier $OP_1$ provides an output signal at time $t_1$ just after power source 1 starts a cycle at time O. Capacitor $C_2$ then starts to charge via resistor $R_{10}$, and cuts off the output of operational amplifier $OP_1$ at a point $t_2$, just before the source begins a new cycle. Capacitor $C_2$ then rapidly discharges via the resistor $R_{11}$ and the operational amplifier $OP_1$. Operational amplifier $OP_2$ has an increasing voltage at its non-inverting input as wiper CONT shifts upwardly to thereby increase its output and thereby increase the charging speed of the capacitor $C_2$. As a result, the charging potential is increased to enlarge the triangular signal from voltage $J_1$ to voltage $J_4$. Voltage $J_1$ corresponds to the lowest position of the wiper CONT sewing basting stitches slowly. $OP_3$ is an operational amplifier having an inverted input which receives a voltage divided by resistors $R_{13}$ and $R_{14}$ between the connections A and B, having a non-inverting input connected to the wiper CONT, and having an output terminal providing a low-level signal when wiper CONT is at its lowest position and providing a high-level signal when the wiper is at positions other than this lowest position. Thus, the operational amplifier $OP_3$ checks the moving and stopping conditions of motor 11. An output signal C from operational amplifier $OP_4$ lights a light-emitting diode LED via resistor $R_{15}$ and operates the phototransistor $PTr_1$ to control the phase of thyristors 10 in dependence upon the lighting phase of the phototransistor.

Figure 7:
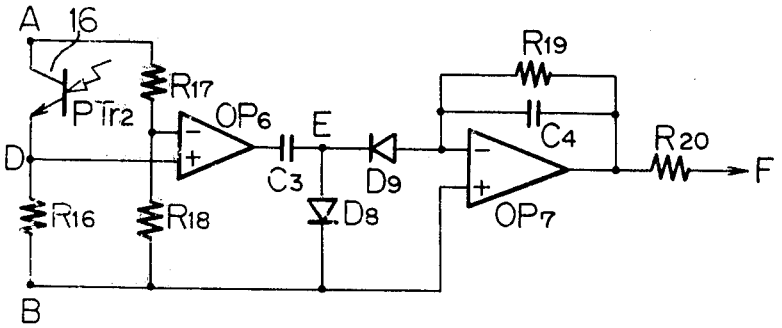
FIG. 7 is a motor speed detecting circuit used in combination with the circuit in FIGS. 5A and 5B.

The circuit in FIG. 7 is used in association with the circuit in FIGS. 5A and 5B and includes a phototransistor $PTr_2$. Phototransistor $PTr_2$ is operated by a rotation speed detector on the main shaft of the sewing machine, and receives light pulses with a period which is proportional to the rotation speed of the sewing machine.

Figure 8:
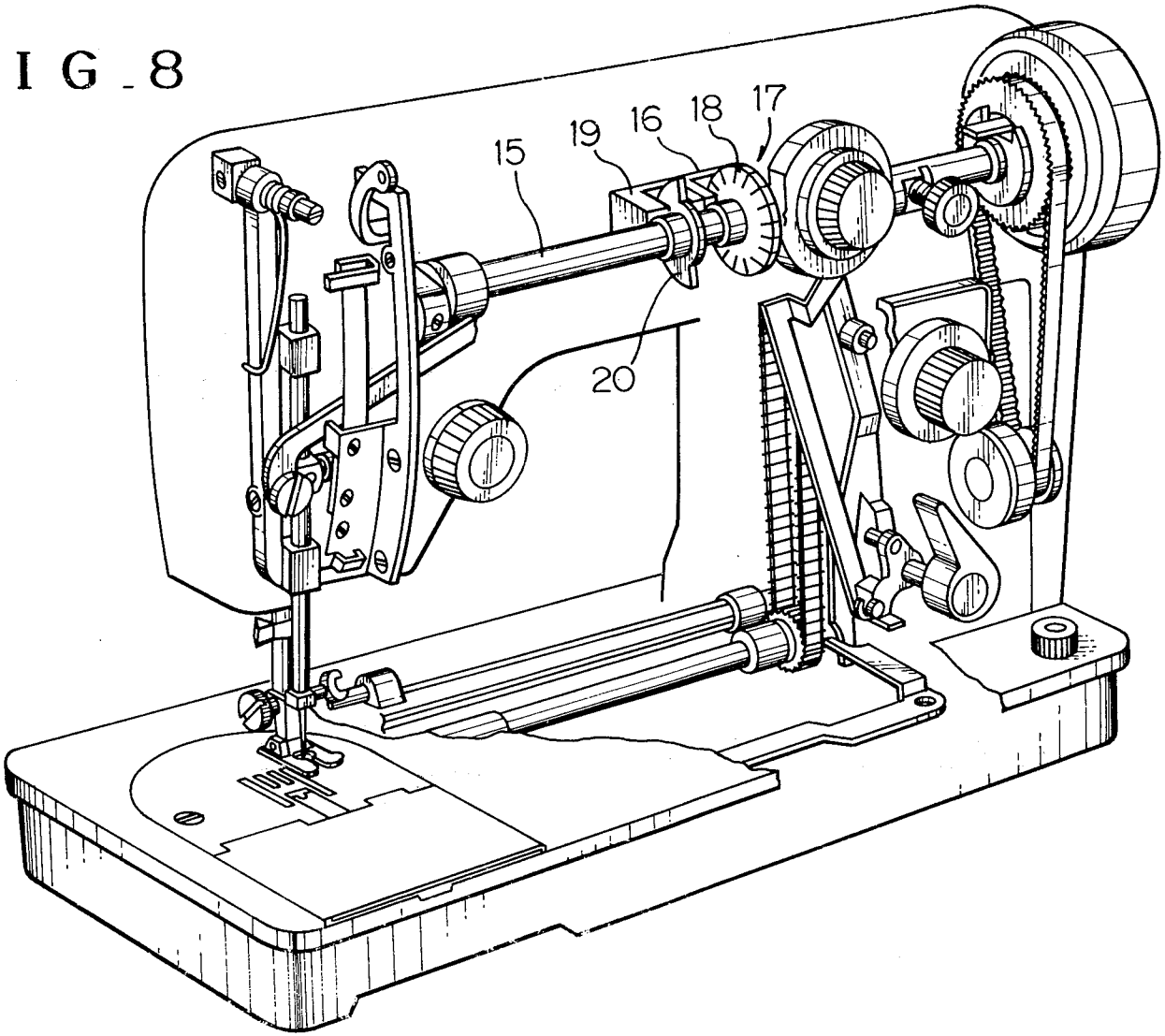
FIG. 8 is a schematic perspective drawing of a sewing machine embodying the invention.

In FIG. 8, reference numeral 15 is an upper shaft of the sewing machine and 16 is a photointerrupter fixed to the sewing machine, including the phototransistor $PTr_2$. A numeral 17 is a screen disc having a plurality of slits 18, and the phototransistor $PTr_2$ is illuminated each time one of the slits 18 is opposite thereto.

Figure 9:
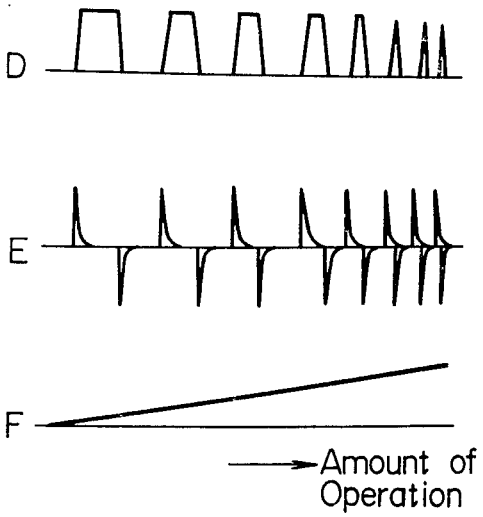
FIG. 9 are graphs associated with the circuit in FIG. 7.

In FIG. 7, the reference letter A indicates a connection to connection A in FIG. 5A and 5B. $OP_6$ is an operational amplifier. $R_{16}$, $R_{17}$, and $R_{18}$ are resistors and a terminal B is connected to terminal B in FIG. 5, constituting a Schmitt circuit together with phototransistor $PTr_2$. As shown in FIG. 9, the emitter voltage D of phototransistor $PTr_2$ has a substantially rectangular waveform relating to the width of the slits 18 in screen disc 17. Advancing to the right side, the width and the period of voltage D become smaller, because wiper CONT in FIG. 5 is progressively moved upwardly and the speed of motor 11 increases. The voltage E across capacitor $C_3$ will be respectively the differential values of the rise and fall of voltage D. $OP_7$ is an operational amplifier. $R_{19}$ and $R_{20}$ are resistors, $C_4$ is a capacitor, which together with capacitor $C_3$ form a frequency-voltage converter. The voltage E is integrated as is shown in FIG. 9 to form a speed signal which is proportional to motor speed. Each example of those values is shown as $F_1$ to $F_4$ in FIG. 6. Terminal F in FIG. 7 is connected to a terminal F in FIGS. 5A and 5B.

Figure 10:
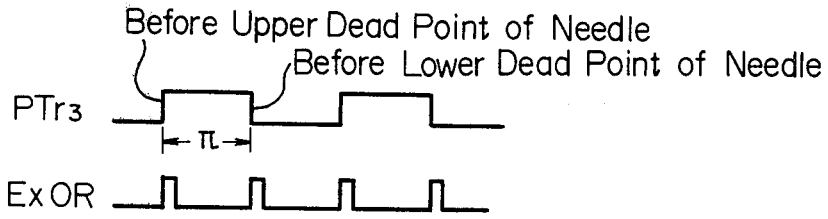
FIGS. 10 to 12 are further graphs associated with the circuit in FIGS. 5A and 5B.

A reference numeral 19 in FIG. 8 is a part of photointerrupter 16 which includes phototransistor $PTr_3$ in FIGS. 5A and 5B. Numeral 20 is a screen element having a large diameter through an angle of 180° and having a small diameter through an angle 180°. FIG. 10 shows the operation of the phototransistor $PTr_3$ versus the rotation angle of the upper shaft 15 of the sewing machine which latter is represented on a horizontal axis. As shown in FIG. 10, phototransistor $PTr_3$ becomes conductive just before the upper shaft 15 completes a half rotation to bring the needle to its upper dead point, and becomes nonconductive just before the upper shaft completes another half rotation to bring the needle to its lower dead point. Referring to FIGS. 5A and 5B, the collector of phototransistor $PTr_3$ is connected to point A, and its emitter is connected through the inverter $IN_1$ to an input of an exclusive OR circuit ExOR and is also connected to another input of the ExOR through a delay circuit composed of the resistor $R_{21}$ and the capacitor $C_5$. $R_{22}$ is a resistor. The output of ExOR provides rising and falling pulses of a width equal to the time delay of the delay circuit, as shown in FIG. 10, at the upper and lower dead points of the needle. Such pulses are applied to AND circuits $AND_1$ and $AND_2$ for stopping the needle at the lower and upper dead points. The output of inverter $IN_1$ is applied as a second input to the AND circuit $AND_1$ and is also applied to another input of AND circuit $AND_2$ through an inverter $IN_2$. $SW_B$ is a switch for producing basting stitches. If switch $SW_B$ is closed, the sewing machine is driven at a low speed and it is possible to stitch intermittently by stopping the needle at the upper dead point on each of the sewing machine. When switch $SW_B$ is opened, one of the inputs of NAND circuits $NA_1$ and $NA_2$ becomes logically high, and becomes logically low when switch $SW_B$ is closed. $SW_C$ is a switch for stopping the needle. When switch $SW_C$ is opened, the needle is stopped at its lower dead point and when switch $SW_C$ is closed, the needle is stopped at its upper dead point. When switch $SW_C$ is opened, the other input of NAND circuit $NA_1$ becomes logically high, and when the switch is closed that input becomes logically low. $R_{23}$ are pulled-up resistors attached to point A. The output of NAND circuit $NA_1$ is applied as a third input to AND circuit $AND_2$ and is also applied as a third input to AND circuit $AND_1$ via an inverter $IN_3$. Basting stitch switch $SW_B$ is connected to the base of the transistor $Tr_1$ via inverter $IN_4$ and resistor $R_{24}$. The collector of transistor Tr2 is connected to the connection between resistor $R_{12}$ and diode $D_7$ in order to ground the output of operational amplifier $OP_2$ when switch $SW_B$ is closed. In this case, resistors $R_{10}$ and $R_{11}$ are so chosen that the output of the operational amplifier $OP_1$ may form signal $J_1$ in FIG. 6. Output Y of operational amplifier $OP_3$ is connected to one input of AND circuit $AND_3$ for detecting the rising of a signal Y on initial operation of the controller, and is applied to the other input of AND circuit $AND_3$ through a delay circuit including inverter $IN_5$, resistor $R_{25}$ and capacitor $C_6$. The output of the delay circuit is connected to set terminal S of flip-flop circuit FF. Signal Y is applied to the input of NAND circuit $NA_2$ together with the signal from basting stitch switch $SW_B$. The output of the NAND circuit $NA_2$ is a first input to AND circuit $AND_4$, for detecting when the motor is to stop. The output of AND circuits $AND_1$, $AND_2$ is applied to a second input of AND circuit $AND_4$ via OR circuit OR. $OP_5$ is an operational amplifier for detecting a low motor speed prior to stopping. Operational amplifier $OP_5$ has a non-inverting input connected to the center point of a voltage divider formed by resistors $R_{26}$ and $R_{27}$, and has an inverting input connected to terminal F in FIG. 7, which carries the speed signal F graphed in FIG. 9. The output of the operational amplifier $OP_5$ becomes logically high only when speed signal F becomes sufficiently low so as to cause the motor to stop, and this output is connected to a third input to AND circuit $AND_4$. The output terminal of AND circuit $AND_4$ is connected to a reset terminal $\underline{R}$ of flip-flop circuit FF. A complement side output $\overline{Q}$ of flip-flop circuit FF is connected to the inverting input of operational amplifier $OP_4$ via diode $D_{10}$, and is also connected to one input of NAND circuit $NA_3$. A true output Q of flip-flop circuit FF is connected to the other input of NAND circuit $NA_3$ via a delay circuit composed of a resistor $R_{28}$ and a capacitor $C_7$. The output of NAND circuit $NA_3$ issues a base signal to a control transistor $Tr_2$ via a resistor $R_{29}$. Transistor $Tr_2$ has its emitter connected to point A, and has its collector connected to a junction between resistor $R_{15}$ and light-emitting diode $LED_1$ via a resistor $R_{30}$ and light-emitting diode $LED_2$. Thus, transistor $Tr_2$ is operated to light light-emitting diodes $LED_1$ and $LED_2$ concurrently. Light-emitting diode $LED_2$ illuminates the phototransistor $PTr_4$, delivering a gate trigger signal to braking thyristor 13. The collector of phototransistor $PTr_4$ is connected to point X. $R_{31}$ and $R_{32}$ designate resistors.

Figure 11:
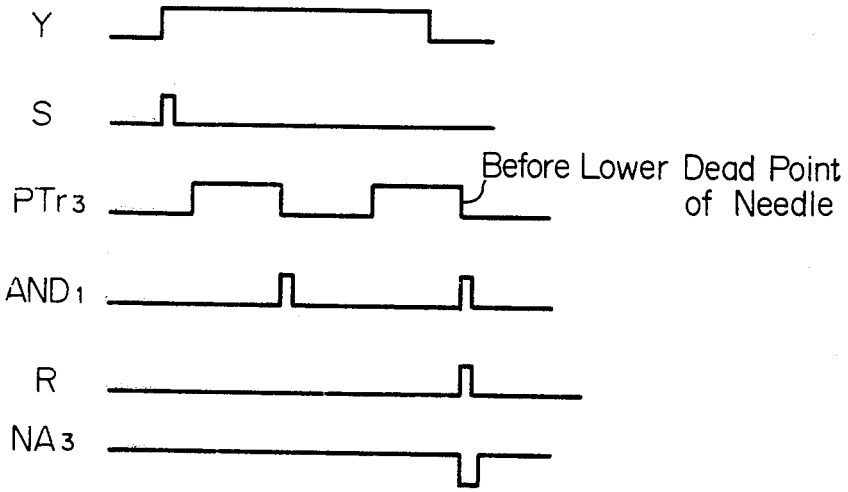
Figure 12:
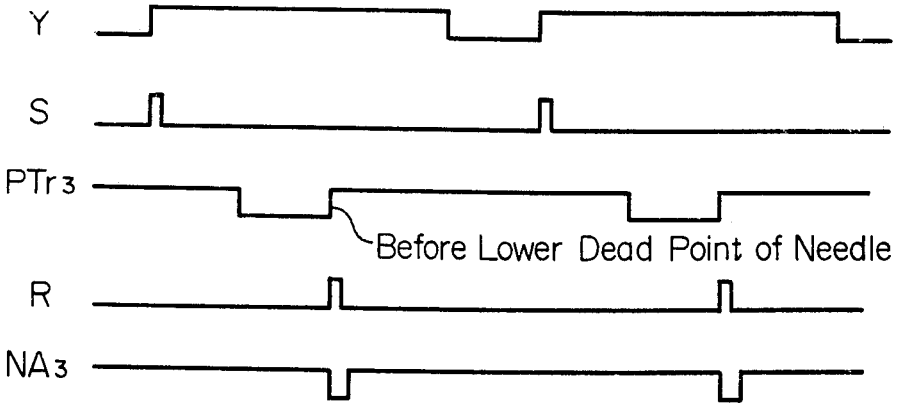

The operation of the combined control circuits shown in FIGS. 5A, 5B and 7 will now be described. When basting stitch switch $SW_B$ is opened, the needle stop switch $SW_C$ is opened (causing the needle stop position to be the lower dead point), wiper CONT of the control (not shown) is positioned at its lowest position, and when AC source 1 is turned on, the operational amplifiers $OP_2$ and $OP_3$ have no output and the operational amplifier $OP_1$ generates the low speed signal $J_1$ shown in FIG. 6. But since output Y of operational amplifier $OP_3$ is logically low, flip-flop circuit FF receives a low set signal at input S and maintains the reset condition which it assumes at power turn on. If AC source 1 is turned on when wiper CONT is positioned at an upper position, output Y of operational amplifier $OP_3$ becomes logically high. But, capacitor $C_6$ and inverter $IN_5$ are logically low, AND circuit $AND_3$ has logically low output and flip-flop circuit FF remains reset. Thus, flip-flop FF is maintained in a reset condition at the time of turnon of power source 1, even if basting stitch switch $SW_B$ and needle stop switch $SW_C$ are operated at such time. Hence, complement side output $\overline{Q}$ is logically high and the inverting input of operational amplifier $OP_4$ is brought high, its output is brought low, and therefore, said $LED_1$ is kept off, $PTr_1$ is not illuminated, and motor 11 remains stopped. When wiper CONT is moved upward in FIGS. 5A, 5B (in case the wiper is at an upper position at the time of power turnon, wiper CONT must be once returned to its lowest position before it is moved up again), voltage at point Y is raised to a logically high level and flip-flop FF receives a signal at set input S for that time required by capacitor $C_6$ to charge via resistor $R_{25}$ during the rise of the signal Y on the transverse time axis shown in FIG. 11. When the signal Y is logically high NAND circuit $NA_2$ has a logically low output and the signal at reset terminal R of flip-flop FF is also logically low, causing flip-flop circuit FF to remain set to generate speed signal F via operational amplifier $OP_4$. $F_1$ in FIG. 6 shows that when the motor is operating at a low speed, firing of thyristors 10 takes place at the time when signal $J_1$ crosses speed signal $F_1$. The phase range shown by oblique lines (in which signal $J_1$ exceeds signal $F_1$) varies as speed signal F varies. In this range, the operational amplifier $OP_4$ has a logically high level output, and light-emitting diode $LED_1$ thus lights in this range. Hence, the firing phase of thyristors 10 feeds back the motor speed. The respective crossing points of speed signals $F_1$–$F_4$ and their respective speed designating signals $J_1$–$J_4$ show the respective ignition phases of thyristors 10 in dependence upon the speed settings determined by movement of wiper CONT for speed control of the motor. Phototransistor $PTr_3$ is at off and does not effect AND circuit $AND_2$ since switches $SW_B$, $SW_C$ are opened, and AND circuit $AND_1$ issues a pulse after phototransistor PTr, is off. When the controller is released the signal at point Y becomes logically low. Since the operational amplifier $OP_5$ has a high level output due to rotation of motor 11, the reset input R of flip-flop circuit FF becomes logically high and the flip-flop is reset at the initial conduction of phototransistor $PTr_3$ after the signal at point Y was low, as is shown in FIG. 11. Thus, the output of operational amplifier $OP_4$ becomes logically low, and light-emitting diode $LED_1$ is not energized thereby. However, output $\overline{Q}$ of flip-flop circuit FF is high, and NAND circuit $NA_3$ issues a low pulse having a width equal to the changing time of capacitor $C_7$ and lights light-emitting diodes $LED_1$ and $LED_2$ during said pulse. This period has a large width exceeding the period $\pi$ of power source 1, and light-emitting diode $LED_1$ instantly short-circuits control thyristors 10 at time $t_5$ in FIG. 4, and light-emitting diode $LED_2$ then fires braking thyristor 13 and the field coil 6 is energized while armature 5 is not. The ignition signals for thyristors 10 and 13 instantly disappear, but armature 5 starts to generate electric power as it begins to rotate. As a result, a circulating electric current flows through braking diode 14, field coil 6 and thyristor 13 and the motor is dynamically braked. Motor 11 is stopped after a point which is just before the lower dead point of the needle has been detected (as shown in FIG. 11 for example, after rotation of around 30°), and the needle of the sewing machine is then set so as to just reach the lower dead point. When the needle stop switch $SW_C$ is closed, AND circuit $AND_2$ is turned on and reset input R of flip-flop circuit FF is pulsed based on the rising current through phototransistor $PTr_3$ in FIG. 11, and the needle thus stops similarly, but at the upper dead point. When basting stitch switch $SW_B$ is closed here, independently of operation of switch $SW_C$, and wiper CONT is moved up, flip-flop circuit FF is set by the rising signal Y (shown in FIG. 12) and motor 11 is driven. Since transistor $Tr_1$ now grounds the output of operational amplifier $OP_2$, motor 11 is driven at a low speed. When the sewing machine is driven for one rotation and current through phototransistor $PT_3$ is detected indicating a point just before the upper dead point of the needle, flip-flop circuit FF is reset and the sewing machine is braked as mentioned above and is stopped at the upper dead point of the needle. Subsequently, the machine is rotated once again and is subsequently stopped after one rotation to cause an intermittent stitching operation, such as basting, to be carried out. In FIG. 12, the operation Y of the controller is logically low after the stop signal $NA_3$ is produced. If the controller is released before the stop signal is produced, braking is not influenced.

Figure 13:
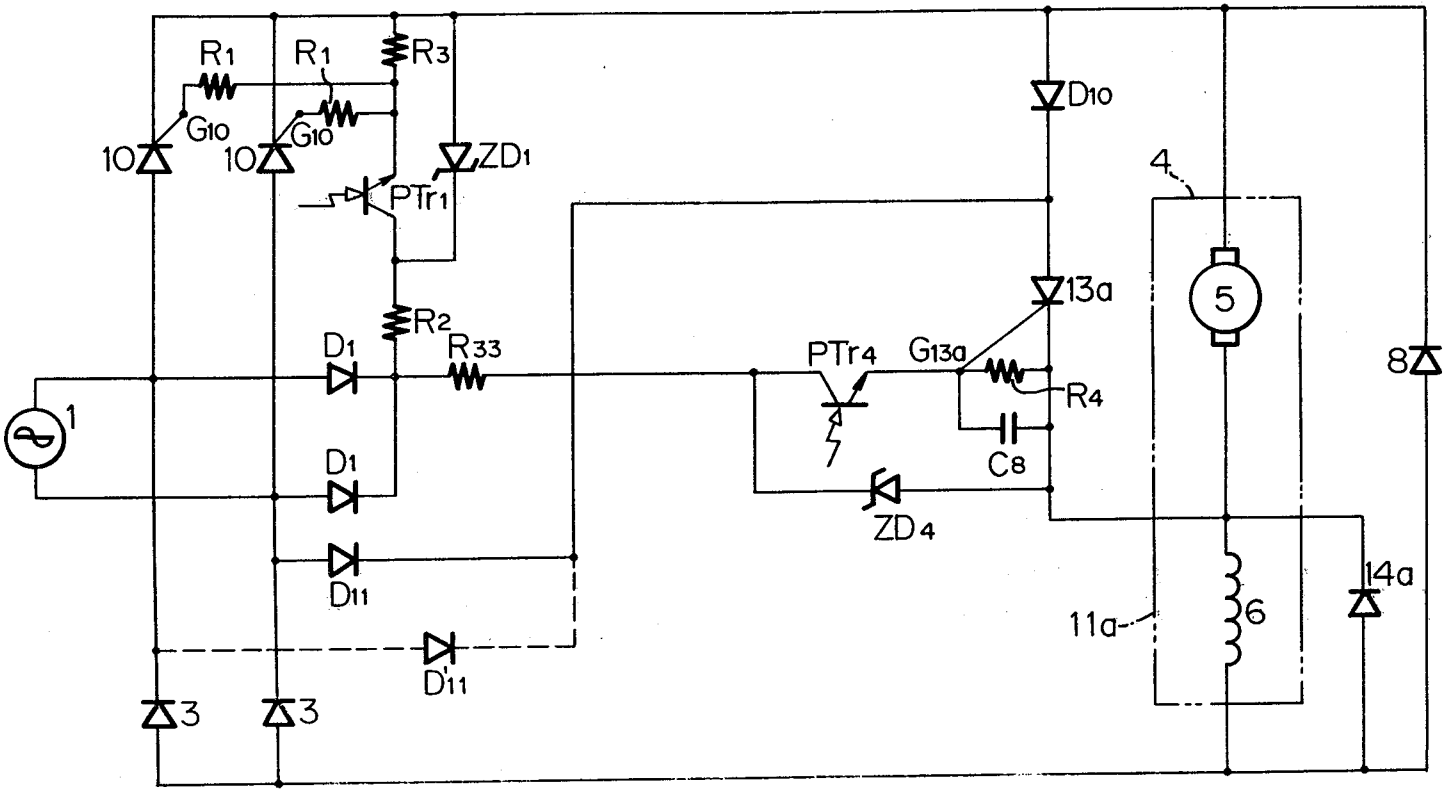
FIG. 13 is a second embodiment of the invention.

FIG. 13 shows another embodiment of the invention, in which elements which are same as those used in FIGS. 3 and 5A, 5B have the same reference numerals. 11*a* is a braking thyristor connected in series with a braking diode $D_{10}$ and in parallel with the armature 5. $G_{13a}$ shows its gate terminal. $R_{33}$ and $R_{34}$ are resistors, and $C_8$ is a capacitor. $ZD_4$ is a diode for operating phototransistor $PTt_4$. A junction between thyristor 13*a* and diode $D_{10}$ is connected to AC source 1 via a diode $D_{11}$ to supply an energized braking current to field coil 6 through thyristor 13*a*. Diode $D_{10}$ prevents a current from being supplied to the armature 5 through diode $D_{11}$.

Figure 14:
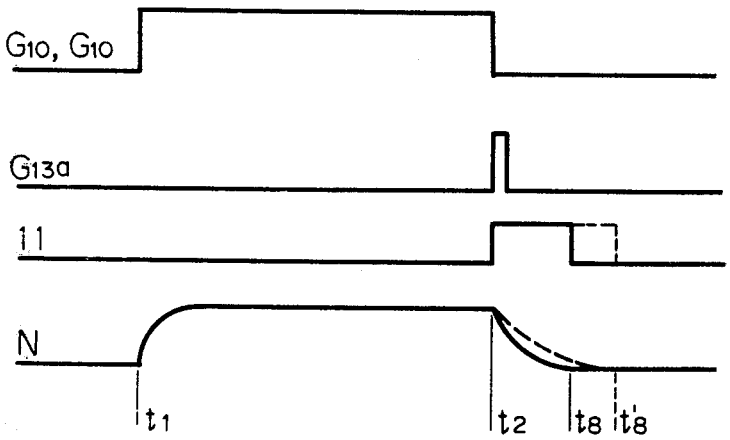
FIG. 14 are graphs associated with the embodiment in FIG. 13.

The main difference between the embodiment of FIG. 3 and the embodiment of FIG. 14 is that braking thyristor 13*a* is ignited by a gate pulse $G_{13a}$ which has a width much narrower than the braking period, and is self-extinguished at time $t_8$ when rotation N of motor 11*a* is stopped. If motor speed follows the dotted line in dependence upon motor load, the conductive period of the thyristor 13*a* will be postponed (as shown by the dotted line) until time $t'_8$. This will now be explained with reference to FIG. 13. After thyristors 10 are ignited by the ignition signals $G_{10}$ and motor 11*a* is rotated, if thyristors 10 are extinguished and thyristor 13*a* is fired at time $t_2$ in order to brake motor 11*a*, the field coil 6 will be energized through diode $D_{11}$ and thyristor 13*a*, and armature 5 will generate electric power on the basis of motor rotation at time $t_2$. As a result, current circulating through diode $D_{10}$ and thyristor 13*a* instantly stops the motor 11*a*. In this instance, the ignition signal $G_{13a}$ of thyristor 13*a* is logically low, but thyristor 13*a* is kept conductive by the circulating current until power generation stops.

Figure 15:
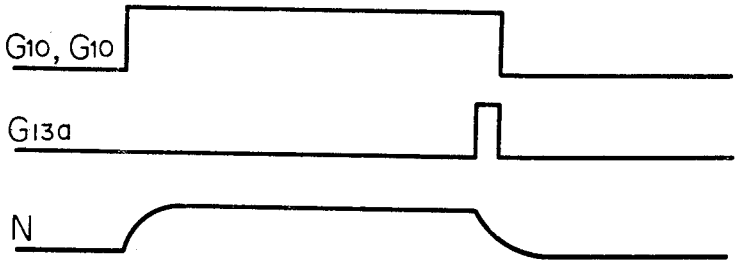
FIG. 15 are further graphs associated with the embodiment of the invention shown in FIG. 13.

FIG. 15 shows that cutoff of thyristors 10 need not be coincident with firing of thyristor 13*a*, as is the case in FIG. 14. If the ignition signal $G_{13a}$ comes slightly earlier than the disappearance of the ignition signal $G_{10}$, motor braking is initiated on the basis of the ignition signal $G_{13a}$. In this case, current flowing through the thyristors 10 temporarily energizes field coil 6 through thyristor 13*a*, instead of through armature 5.

In FIG. 13, the braking current flowing through diode $D_{11}$ is half-wave rectified. An additional diode $D_{11}$ can be connected as shown to produce a full-wave rectified current so as to increase the braking effect.

In accordance with the invention as shown particularly in FIGS. 5A, 5B and 6, the signals $J_1$–$J_4$ at the non-inverting input of operational amplifier $OP_4$, (which is controlled by operation of the wiper CONT) start from zero potential at a zero crossover of power source 1, and end near the next crossover as substantially straight lines with different slopes. On the other hand, signals $F_1$–$F_4$ at the inverting input of operational amplifier $OP_4$ rise in proportion to motor speed. The crossing points of the two inputs of $OP_4$ can control the ignition angle of the thyristors 10 in a broad range. In the case of this voltage comparison, only a voltage proportional to motor speed is used while voltage of the power source is not. Therefore, speed response is good. Especially during low speed rotation of motor 11, the inclination of signal $J_1$ is small, causing the ignition phase of thyristors 10 to be broadly varied by any change in motor speed due to the variation of machine load. Thus, the invention provides an excellent control for motor speed and braking.

It will be understood that each of the elements described above, or two or more together, may also find a useful application in other types of sewing machine motor control systems differing from the types described above.

While the invention has been illustrated and described as embodied in a control system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. A braking and speed control circuit for use with a DC series motor having a field coil and an armature winding which are entirely in series with each other, which motor is driven by a phase-controlled AC source, comprising;

a forward-biased diode intermediate the field coil and the armature winding and in series therewith;

a first reverse-biased diode placed in parallel with a first series network including only the field coil and the forward biased diode;

a second reversed-biased diode placed in parallel with a second series network including only the field coil, the forward-biased diode and the armature winding; and a forward-biased semiconductor switch placed in parallel with a third series network including only the forward biased diode and the armature winding.

2. The circuit defined by claim 1, wherein the semiconductor switch is a thyristor.

3. The circuit defined by claim 1, further including a means coordinating operation of the semiconductor switch with phase-control of the source in a manner that by a time when the motion has been braked to a stop, the semiconductor switch is opened and the AC source is turned off.

4. The circuit defined by claim 3, wherein the semiconductor switch is a thyristor which is held conductive by electric current generated by the motor during braking.

5. The circuit defined by claim 3, wherein the means furthermore controls place of the AC source in dependance upon motor speed in order to hold motor speed to a constant value.

6. The circuit defined by claim 5, wherein the constant value is user-variable.

* * * * *